United States Patent [19]

Davis

[11] 4,248,522

[45] Feb. 3, 1981

[54] SOLID METERING ROLL

[75] Inventor: Austin E. Davis, Nashua, N.H.

[73] Assignee: Nashua Corporation, Nashua, N.H.

[21] Appl. No.: 40,901

[22] Filed: May 21, 1979

[51] Int. Cl.[3] ..... G03G 15/10

[52] U.S. Cl. ..... 355/10

[58] Field of Search ..... 355/10, 15; 118/644, 118/652, 262; 430/117–119, 125

[56] References Cited

U.S. PATENT DOCUMENTS

| | | | |
|---|---|---|---|
| 1,364,043 | 12/1920 | Dixon | 118/262 X |
| 1,404,589 | 1/1922 | Dixon et al. | 118/262 X |
| 2,991,753 | 7/1961 | Dearsley | 118/262 |
| 3,245,377 | 4/1966 | Gettel | 118/119 |
| 3,907,423 | 9/1975 | Hayashi et al. | 355/10 |
| 3,957,016 | 5/1976 | Yamada et al. | 355/10 X |
| 4,023,899 | 5/1977 | Hayashi et al. | 355/10 |
| 4,052,959 | 10/1977 | Hayashi et al. | 355/10 X |
| 4,056,315 | 11/1977 | Ariyama et al. | 355/10 |

FOREIGN PATENT DOCUMENTS

| | | | |
|---|---|---|---|
| 269855 | 11/1964 | Australia | 355/10 |

*Primary Examiner*—William H. Beha, Jr.
*Attorney, Agent, or Firm*—Kenway & Jenney

[57] ABSTRACT

A metering roll, employed between the developing station and the transfer station of a photocopier which uses a liquid toner, controls the thickness of the liquid on the photosensitive drum surface when it is presented to the transfer station. The metering roll has a central metering portion and a distance control position at each end. The metering portion and the distance control portions are coaxial and have a fixed angular relationship with respect to each other. The metering roll distance control portions are urged against the moving copier photosensitive drum surface and rotate in the same angular direction as the drum. Thus the distance control portions engage drum surface edges in a sliding frictional relationship. The distance control portions are sized to maintain the central metering portion in a substantially constant spaced apart relationship to the drum surface and thereby tend to limit and control the thickness of developer on the drum surface at the transfer station. A neck portion adjacent the central metering portion at each of its ends helps to prevent buildup of developer fluid on the distance control portions.

11 Claims, 9 Drawing Figures

SOLID METERING ROLL

BACKGROUND OF THE INVENTION

The invention relates generally to photocopiers employing liquid toner developer, and particularly to apparatus for removing excess liquid developer from a photosensitive drum surface before transfer of the image to a copy material.

In a photocopier employing a rotating photosensitive drum surface, the drum surface is electrically charged and then exposed to an original light pattern to form a latent electrostatic image on the surface. The latent image is developed, for example by contacting a liquid developer to the image, and the developed image is transferred onto copy material by a transfer process. The drum is thereafter cleaned and used again.

In photocopiers employing liquid toner development, it is necessary prior to the transfer step to remove excess liquid developer remaining on the drum after development. The development process is not precise, and excess developer remaining on the drum surface can cause a blurry or fuzzy image on the transfer material and can excessively wet the transfer material so that drying would either take longer or be incomplete.

Among the devices used in the past to remove excess liquid from a wet surface have been rollers of one form or another. For example, in the printing and paper industry, it was common to rest a roller directly on the wet surface to remove excess liquid. (See for example U.S. Pat. No. 3,245,377, to Gettel). In those applications wherein the roller could not be placed directly upon the surface, various methods and apparatus for maintaining the roller spaced above the surface were employed. For example, the roller axis or shaft could be fixed to the apparatus frame, (for example Australian Patent No. 269855), or the roller could be supported by roller bearings which ride on and are driven by the surface being controlled. Each of these apparatus configurations was available prior to the introduction of the first plain paper liquid copiers and apparatus employing the roller bearing method and apparatus described earlier were adopted almost simultaneously by at least two competing manufacturers for their commercial photocopiers. The manufacturers merely differed with respect to the direction of rotation of the operational roller, the different rotation directions having also been considered and disclosed previously in connection with related operating systems.

In each apparatus employing roller bearings to space the roller from the drum surface, the roller rotates with respect to the roller bearings. It is therefore imperative to provide bushings, bearings, or the equivalent structure between the two differentially rotating parts. The adjustment, lubrication, and most importantly, the sealing of these roller bearings require careful attention, consideration, and control, and effectively increase the cost of the apparatus. Further, the commercial apparatus employing the roller bearing systems often employed hardened drum edges, for example, anodized aluminum, to further reduce wear from the rolling friction of the roller bearings on the drum.

It is a principle object of this invention to provide a reliable, relatively inexpensive metering apparatus having no roller bearings and not requiring the hardened drum edges. Further objects of the invention are a metering apparatus which is easier and less expensive to manufacture, which has low wear characteristics, which has a long lifetime, and which is substantially unaffected by the liquid toner developer solutions.

SUMMARY OF THE INVENTION

The invention relates to copying apparatus having a drum rotating in a first direction and the drum having a reuseable photosensitive surface. The copying apparatus further has a liquid developing station and a transfer station.

The invention features a metering apparatus for controlling the thickness of the liquid toner developer on the drum prior to the transfer station. The apparatus has a metering roll having a metering portion and having two ends to which distance control portions are rigidly secured in coaxial relationship so that the metering portion and the control portions have a fixed rotational relationship to each other. The distance control portions are sized to maintain the metering portion in a spaced apart relationship with the drum as the metering roll is biased against the drum and is rotated in the same rotation direction as the drum. Thereby, the distance control portions contact the drum in a sliding frictional relationship and excess developer liquid is prevented from reaching the transfer station. Thus, a desired thickness of developer passes through the gap between the drum and the spaced apart metering portion to the transfer station.

In preferred embodiments, the distance control portions are releasably secured to the metering portion. The control portions have channels corresponding to pins which transversely extend through a shaft member (which extends from the metering portion) and with which the metering portion is coaxial. The mating channels and pin members fix the rotational relationship noted above. Also in preferred embodiments, the drum may have aluminum substrate edges, that are respectively contacted by the distance control members, and a photosensitive surface portion covering the central circumferential portion of the drum substrate. The metering roll may include neck portions of reduced diameter adjacent the ends of the metering portion.

BRIEF DESCRIPTION OF THE DRAWINGS

Other objects, features and advantages of the invention will appear from the following description of a preferred embodiment and the drawings, in which.

DESCRIPTION OF A PREFERRED EMBODIMENT

Figure 1:
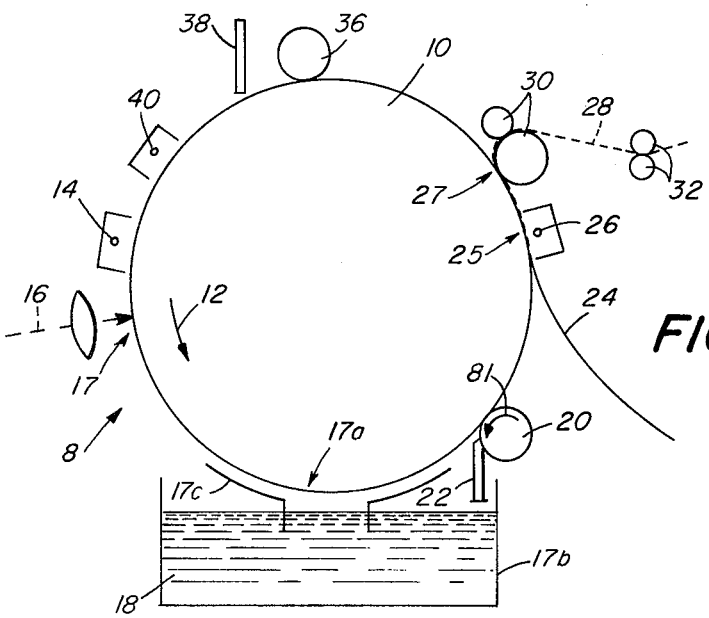
FIG. 1 is a schematic front elevation view of a photocopier in which the present invention is incorporated.

Referring to FIG. 1, a photocopier 8 in which the present invention can be employed, has a photosensitive drum 10, preferably one having a photosensitive selenium layer deposited on an aluminum substrate, rotating in the counterclockwise direction as indicated by arrow 12. A charge corona 14 charges the drum 10 to about +1000 volts D.C. The charged drum is exposed to an image 16 at an exposure station 17. The image is focused on the drum photosensitive surface and thereupon the charge on the drum surface forms an electrostatic latent image comprising a pattern of electrical charges. The electrostatic latent image on the drum surface is brought to a development station 17*a* where a liquid developer having a negatively charged toner contacts the electrostatic image to develop the image. The development station includes a developer tank 17*b* and a development electrode 17*c*. Developer is introduced between the development electrode and the drum surface to develop the electrostatic image. The drum surface now wetted and carrying the developed image travels past a metering roll 20, which controls and limits the thickness of the liquid on the drum surface. A wiper 22 engages a central metering portion 23 (FIG. 2) of the metering roll 20, and removes the excess liquid that accumulates on the metering roll. A copy material 24, which is preferably sheet material, is fed to the drum surface at a transfer station 25. A positive charge from a transfer corona 26 is applied to the back side of the copy material 24, causing the transfer of toner particles from the developed image on the drum's surface to the copy material. The copy material is then removed from the drum surface at 27 and follows a path 28 dictated by rollers 30 and 32.

After transfer, there remains on the drum a residue of liquid developer. The drum is continuously cleaned of this remaining residue by a surface contacting cleaning roller 36 and a cleaning blade 38. Finally, the drum surface is electrically neutralized prior to the next charging step by a high A.C. neutralizing charge from a discharge corona 40.

When the drum surface passes the surface area defined by the development electrode 17*c*, it has on its surface the developed image plus an excess amount of liquid developer. If the transfer material 24 were brought into contact with the drum when it has the excess developer, the transfer sheet, if it were for example paper, would be excessively wetted and would be difficult to properly dry. In addition, the resolution of transferred image could be reduced by excessive levels of liquid on the drum. The solution to this problem according to the preferred embodiment is the metering roll 20.

Figure 2:
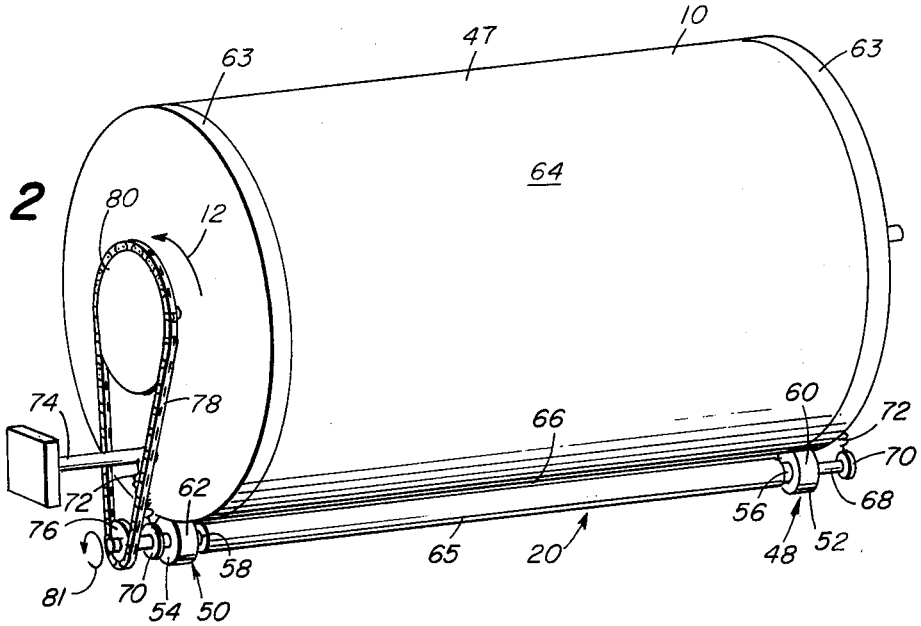
FIG. 2 is a perspective view of a portion of the photocopier of FIG. 1, showing the structural interrelationship of the drum and a metering roll according to the invention.

Referring to FIG. 2, the structural relationship of the drum 10 and the metering roll 20 is shown. The drum 10 rotates about a drum shaft 42 in the direction of the arrow 12. The relative spacing and sizes of the metering roll 20 have been exaggerated to enable a clearer understanding of the invention.

The metering roll 20 has the central metering portion 23 and distance control portions 48 and 50 secured at each end thereof. The illustrated distance control portions 48 and 50 consist of cylindrical disc members 52 and 54 separated from the metering portion by smaller diameter neck portions 56 and 58 respectively. The relative axial dimensions of the respective portions of the metering roll 20 can be best illustrated by the dimensions for a typical application, wherein the central metering portion 23 would be about 10.5 inches long, the distance control portions 48 and 50 would each be about 0.5 inches long, for the neck portions 56 and 58 would be about 0.2 inches in length. The distance control portions 48 and 50 are sized to maintain the central metering portion 23 in a spaced apart relationship with the drum surface. For example, where the drum surface has a substantially constant radius for its entire axial length, the radius of the distance control portion can be about 0.5520 inches and the radius of the central metering portion can be about 0.5470 inches. (The drum radius is about 2.35 inches.) Thereby, according to this preferred embodiment, in the arrangement of FIG. 2, wherein the surfaces 60 and 62 of the distance control portions 48 and 50 are urged against the edges 63 of the drum surface 64, the surface 65 of the central metering portion 23 is spaced apart from the drum surface 64. The gap 66 thereby formed between drum surface 64 and metering portion surface 65 taking into account an approximately 0.0015 inch layer of selenium, is about 0.0035 inch. As noted above, the neck portions 56 and 58 have diameters less than the diameter of the metering portion 23.

The metering roll 20 is mounted for movement toward and away from the drum surface by a shaft 68 extending beyond the distance control portions 48 and 50 and through spring biased bushings or bearings 70. Bushings or bearings 70 are connected by springs 72 to support mountings 74 secured to the frame (not shown) of the photocopier apparatus. The springs 72 urge the metering roll 20 toward the drum surface 64 and maintain the surfaces 60 and 62 of the distance control portions in a sliding frictional contact with the drum edges 63.

The illustrated metering roll shaft 68 has a driven gear 76 attached thereto. Gear 76 is driven by a chain 78 connected to a drive gear 80 mounted on the drum shaft 42. This drive structure causes metering roll 20 to rotate whenever the drum 10 is rotating, and the metering roll rotates, as a unitary element, in the counterclockwise (as seen in FIG. 1) direction indicated by the arrow 81. Thus the metering roll 20 rotates in the same angular direction as the drum (compare arrows 12 and arrow 81). And when the drum and metering roll are rotating, the entire metering roll 20 thus rotates as one element because the metering portion and distance control portions have a fixed rotational relationship with respect to one another. As a result the surfaces 60 and 62 of the distance control portions 48 and 50 frictionally slide over the drum surface edges 63 as they move in a surface direction opposite to the drum surface. The central metering portion 23 moves in the same direction as the distance control portions; that is, its surface 65 is also moving in a surface direction which is opposite to the direction of movement of the drum surface 64.

Figure 4:
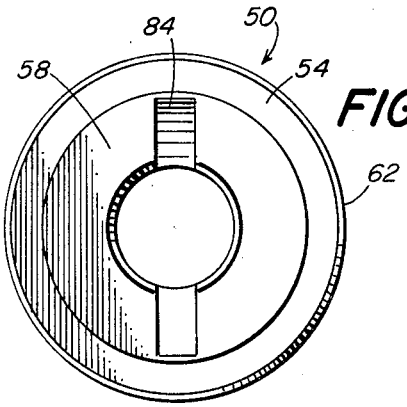
FIG. 4 is a front elevation of a distance control portion of the metering roll according to the invention.
Figure 5:
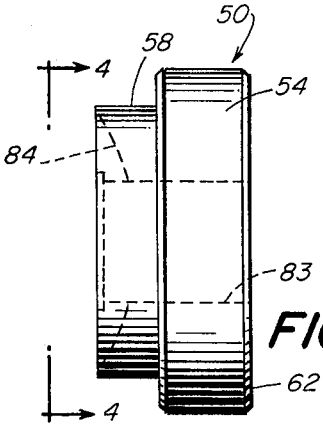
FIG. 5 is a side elevation of the distance control portion of FIG. 4.
Figure 6:
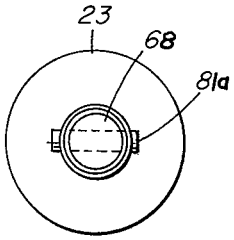
FIG. 6 is an end view of a metering portion of the metering roll.
Figure 7:
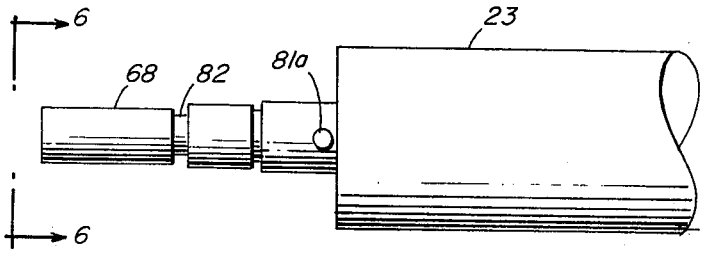
FIG. 7 is a plan view of the end of the metering portion of FIG. 6.

Details of a first embodiment of the metering roll 20 appear in FIGS. 3–7 of the drawings. Referring to FIGS. 6 and 7, in the illustrated preferred embodiment, the metering portion is an elongated cylinder having a circular cross section and fabricated from solid aluminum stock. The shafts 68 of aluminum extend from the ends of the central metering portion and can be part of the original stock, can be a single steel shaft extending through the roll, or can be for example machined rods which are press fit into previously bored receiving holes in the ends of the metering portion. In either instance, shafts 68 are coaxial with portion 23. The shafts 68 in the illustrated embodiment each have a pin 81*a* extending transversely through and secured to the shaft. The shafts 68 further have grooves 82 for receiving E-rings as described below.

Referring to FIGS. 4 and 5, the illustrated distance control portion 50 (distance control portion 48 is of identical structure) comprises the disc portion 54 and the neck portion 58. A bore 83 through the distance control portion 50 is concentric with the outside surface 62, and receives the shaft 68 of the central metering portion 23. An indexing channel 84 is formed in the face of the neck portion 58, and is dimensioned to receive the indexing pin 81*a* in a press fit. The distance control portion 50 is preferably formed from a polyolefin such as one sold under the trademark "Pennlon" by Dixon Corporation, Bristol, Rhode Island. However other materials such as Teflon, vinyl acetals, olefins, Rulon, etc., which have the necessary lubricity and wear characteristic can also be employed. In particular, the material comprising the surfaces of the distance control portions should be self-lubricating to reduce sliding friction with the drum, and should be hard and tough to provide long life.

Figure 3:
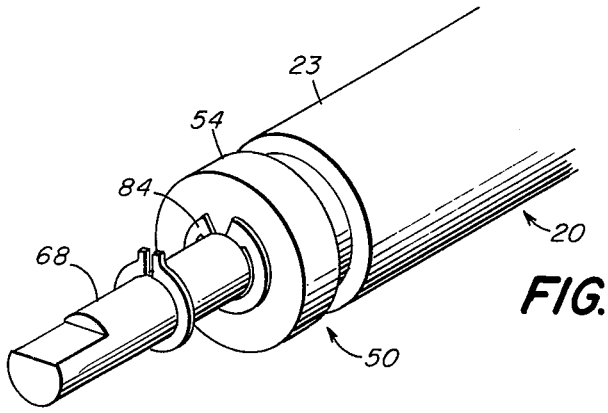
FIG. 3 is a perspective view of one end of the metering roll according to the invention.

Referring to FIG. 3, the assembled metering roll 20 has the distance control portion 50 in engagement with the shaft 68 and adjusted until its indexing channel 84 lines up and forms a press fit with the shaft pin 81*a*. The pins 81*a*, when positioned in the indexing channel, determine the rotational relationship of the distance control portions and the metering portion. One of the grooves 82 in the shaft 68 is located so that an E-ring 84 can be snapped into position in the inner groove to secure the distance control portion adjacent to and preferably in contact with an end of the metering portion. The distance control portion 50 and central metering portion 23 are carefully formed and assembled so that they are coaxial. This is important so that the gap 66 between the drum and the metering portion stays substantially constant during rotation of the roll 20.

In operation, the metering roll removes the excess liquid remaining on the drum surface after development, that is, the step of contacting liquid developer to the drum at the development electrode. The gap 66 between the metering portion 23 and the drum surface is one of the parameters, as is well known in the art, which sets the thickness of the liquid developer presented to the transfer station.

Thus according to the invention, the entire illustrated metering roll 20 rotates as a single unit and is shown being driven by the drum shaft. In the illustrated embodiment, the drum can rotate, for example, at 34 rpm and the metering roll can rotate, for example, at about 396 rpm. The unitary construction of the metering roll, in combination with the disclosed mode of operation provide that the surfaces 60 and 62 of the respective distance controlling portions are in sliding, frictional contact with the oppositely moving drum surface edges 63.

The neck portions 56 and 58 of the distance control portions of the metering roll 20 provide relief channels for liquid developer that may be forced sideways (parallel to the drum or roller axis) by the action of the metering portion 23. They prevent such developer from being forced up and over the distance control portion surfaces, and also prevent such an accumulation of liquid developer between the metering roll 20 and the drum 10 whereby undesirable electrical conduction paths can be formed.

The distance control portions 48 and 50 are, in the embodiment shown, made separately, and then are secured to the central portion 23 of the metering roll to form a unitary unit. This is done for ease of manufacture. The diameters of the distance central portions and the central portion are generally different and it is therefore easier to form them separately. In addition, the illustrated structure aids maintenance, because, if distance control portion wears, for example, it can be replaced without replacing the more expensive central metering portion.

Figure 8:
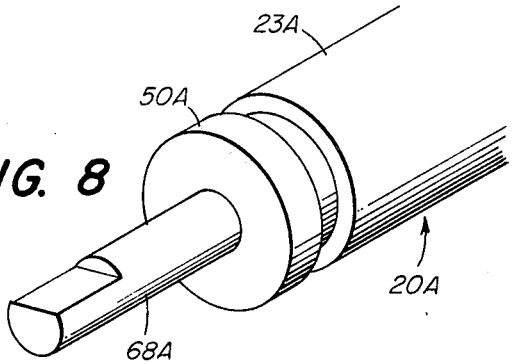
FIG. 8 is a perspective view of one end of an alternative embodiment of a metering roll according to the invention.

Referring to FIG. 8, in another construction, according to the invention, a metering roll 20A is made from a single length of material. That is, the distance control portions 50A are formed from and are structurally an extension of the metering portion 23A. Portions 50A, in the illustrated embodiment, have a slightly greater radius than the central metering portion 23A. Thus the distance control portion 50A is not a separate piece having a fixed rotational relationship to the metering portion 23A but is a physical extension of the metering portion 23A itself.

Several alternate structures can be employed in constructing metering roll 20A according to the invention. For example, the roll, including extending shaft members 68A can all be formed from an electrically insulating olefin. Alternately, the metering portion 23A and the distance control portions 50A can be formed from a single material and then a coaxial bore can be introduced through the roll to receive a steel shaft. Other embodiments will be suggested to those practiced in the art.

Figure 9:
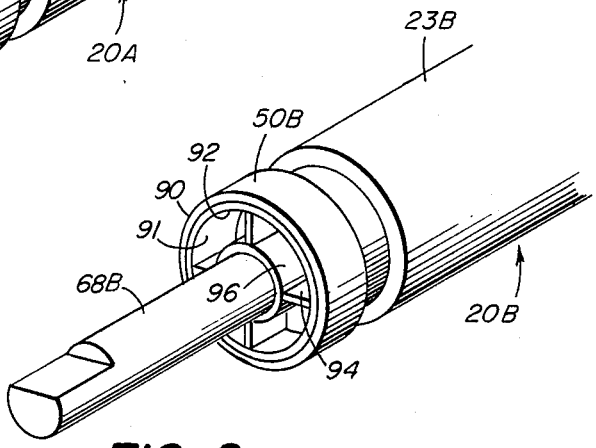
FIG. 9 is a perspective view of another embodiment of a metering roll according to the invention.

Referring to FIG. 9 another construction, according to the invention, of the metering roll 20B, has distance control portion 50B constructed of a cylindrical band 90 of an electrically insulating material secured to a hub member 91. Band 90, which can be "Pennlon", has the lubricity and wear characteristic of portion 50.

Illustrated hub member 91 has an outer rim 92 connected, for example by struts, or spokes, 94 to a central hub 96. Hub 96 can be press fit on the shaft 68B (extending from the metering portion 23B). Alternatively hub 91 can be a solid hub member, made from for example aluminum, and secured in a convenient structural connection to shaft 68B. Other constructions of this "rim and tire" construction will occur to those practiced in the art.

SUMMARY OF THE ADVANTAGES OF THE INVENTION AND NON-OBVIOUSNESS

The metering roll according to the invention advantageously provides a simpler structure than prior art devices and operates in a substantially different mode of control and operation by providing distance control elements which are rotationally fixed to the metering portion of the metering roll. This structure eliminates the necessity and severe structural designs of the roller bearings of prior art devices and simultaneously allows the elimination of a hardened edge portion on the drum ends found in some commercially available copiers. By employing the materials specified herein for the distance control portions (or equivalent materials), long life and high reliability of the metering roll can be achieved.

The metering roll described herein is significantly different than prior art apparatus. The prior art photocopy apparatus, for example that described in U.S. Pat. No. 3,957,016, U.S. Pat. No. 3,907,423, U.S. Pat. No.

4,023,899, and U.S. Pat. No. 4,052,959, appear to contemplate and require roller bearings on the ends of the roller in order to space the roller with respect to the drum. This is exactly the kind of structure which has been employed in connection with coating or printing equipment. Also, in the prior art copier systems the roller bearings are driven by the copier drum member in order to maintain a rotating, non-sliding, friction drive relationship between the drum and the bearings, and, according to the prior art, to reduce or minimize drum wear. Nevertheless, anodized hardened edge portions were considered necessary and were employed on the drum to further minimize the effects of wear.

The use of roller bearings is clearly described by earlier references which employ roller bearings to accomplish and achieve substantially the same effect. The use of those roller bearings in connection with photocopier rollers is a natural extension of the prior art systems.

The claimed invention on the other hand employs a rigid metering roller which operates contrary to the teachings in the art and provides a continuously sliding frictional contact between the distance control elements and the drum edge. Surprisingly, by the proper choice of materials to provide low-wear and lubricity, the hardened edges of the drum can be eliminated and reliable and high quality operation is achieved. The present invention eliminates the necessity for providing roller bearing members which must be properly sealed from the effects of the developer. This is a multi-faceted "sealing" problem and is of no moment in the claimed structure since there are no bearings to remain lubricated and free, or to be maintained in the lubricated condition.

Thus, the elimination of roller bearings and the construction of a metering roll according to the claimed invention is contrary and opposite to the conventional thought that the design of friction creating surfaces is to be avoided. To the contrary, the claimed invention provides a simple solution to the metering problem and eliminates the requirement of the expensive roller bearing members in the prior art systems. Further, the claimed invention provides significantly different structures acting on the drum surface in a significantly different manner in order to provide the metering function. Thus, for example, the distance control portions of the present invention are not driven by the drum and in the preferred embodiment of the invention are separate replaceable members. The prior art roller bearing structures are on the other hand driven by the drum and are not, because of the bearing function which they perform, as easily replaceable.

Modifications of the disclosed embodiment are contemplated and would be within the scope of the invention. For example, the distance control portions could be fastened to the central portion in a variety of ways, or as noted above, the entire metering apparatus roller could be formed or molded from a single length of material. Similarly, though not part of the invention, various ways of driving the metering roll, which are different than the gear arrangement shown, for example the use of a separate motor, are possible. Also the metering roll could be biased against the drum by other than the disclosed spring elements. Thus additions, subtractions, deletions and other modifications of the disclosed embodiment will be obvious to those skilled in the art and are within the scope of the following claims.

I claim:

1. In a copying apparatus having a drum having a reuseable photosensitive surface, said drum rotating in a first rotation direction, a developing station for contacting liquid toner to said drum surface to develop an electrostatic image, and a transfer station for transferring said developed image to a transfer material, apparatus for controlling the thickness of the liquid on the drum prior to said transfer station comprising a metering roll having a metering portion having a first end and a second end and distance control portions rigidly secured in coaxial relationship to each of said ends so that said metering portion and said distance control portions have a fixed rotational relationship whereby they do not rotate relative to each other, said distance control portions being sized to maintain said metering portion in a spaced apart relationship with said drum, means for biasing said metering roll toward the drum, and means for rotating said metering roll in said first rotation direction, whereby said distance control portions contact said rotating drum in a sliding, opposing frictional relationship.

2. The apparatus of claim 1 wherein said distance control portions are releasably secured to said metering portion.

3. The apparatus of claim 2 wherein said metering portion further comprises first and second axial shaft elements extending from said first and second ends, said shaft elements each having a pin member extending transversely therethrough, and said distance control portions each have pin receiving indexing channels, whereby each said distance control portion, in an operative relation to said metering portion, mechanically engages said pins for fixing the rotational relationship of said control portions and said metering portion.

4. The apparatus of claim 1 wherein said distance control portions and said metering portion are formed from a single length of a starting material.

5. The apparatus of claim 4 wherein said metering roll further comprises a coaxial shaft extending axially through said roll.

6. The apparatus of claim 1 wherein said drum has an aluminum substrate, said photosensitive surface covers only a central circumferential surface portion of said substrate, and said distance control members contact said aluminum substrate during said sliding frictional relationship.

7. The apparatus of claim 1 wherein said metering roll further comprises a neck portion of a diameter less than the diameter of said metering portion, said neck portion being coaxial with said metering portion and adjacent said ends of said metering portion.

8. The apparatus of claim 1 wherein said metering portion further comprises first and second axial shaft members extending from said first and second ends, and each said distance control portion comprises a hub portion fixed to each said shaft member, rim-supporting members extending from said hub portion, and rim members connected to said hub portion by said rim supporting members.

9. In a copying apparatus having a drum having a reuseable photosensitive surface, said drum rotating in a first rotation direction, a developing station for contacting liquid toner to said drum surface to develop an electrostatic image, and a transfer station for transferring said developed image to a transfer material, apparatus for controlling the thickness of the liquid on the drum prior to said transfer station comprising a metering roll having a metering portion having a first cross-sectional diameter and a first end and a second end, and distance control portions rigidly secured in coaxial relationship to each of said ends so that said metering portion and said distance control portions have a fixed rotational relationship whereby they do not rotate relative to each other, said distance control portions each having a second cross-sectional diameter greater than said metering portion first diameter to maintain said metering portion in a spaced apart relationship with said drum, means for biasing said metering roll control portions against the drum, and means for rotating said metering roll in said first rotation direction, whereby said distance control portions contact said rotating drum in a sliding, opposing frictional relationship.

10. The apparatus of claim 9 wherein said metering roll further comprises a neck portion of a diameter less than the diameter of said metering portion, said neck portion being coaxial with said metering portion and adjacent said ends of said metering portion.

11. In a copying apparatus having a drum having a reuseable photosensitive surface, said drum rotating in a first rotation direction, a developing station for contacting liquid toner to said drum surface to develop an electrostatic image, and a transfer station for transferring said developed image to a transfer material, apparatus for controlling the thickness of the liquid on the drum prior to said transfer station comprising a metering roll having a central cylindrical metering portion having a first cross-sectional diameter, first and second axial shaft portions extending from said metering portion, distance control members comprising a circumferential portion having a second diameter greater than said first diameter, a neck portion having a third diameter less than said first diameter, shaft engaging means for coaxially securing said distance control member to said shaft, and means for releasably, non-rotatably securing each said distance control member on a said respective shaft, said distance control portions being sized to maintain said metering portion in a spaced apart relationship with said drum, means for biasing said metering roll control portions against the drum, and means for rotating said metering roll in said first rotation direction, whereby said distance control portions contact said rotating drum in a sliding frictional relationship.

* * * * *